US011587542B2

(12) United States Patent
McAllister et al.

(10) Patent No.: US 11,587,542 B2
(45) Date of Patent: Feb. 21, 2023

(54) TEMPORARY NOISE POLLUTION INTERRUPTION WALL SYSTEM AND METHOD

(71) Applicant: A&M Innovations Inc., Red Deer (CA)

(72) Inventors: Wade McAllister, Sylvan Lake (CA); Bryan Armstrong, Medicine Hat (CA)

( * ) Notice: Subject to any disclaimer, the term of this patent is extended or adjusted under 35 U.S.C. 154(b) by 524 days.

(21) Appl. No.: 16/864,995

(22) Filed: May 1, 2020

(65) Prior Publication Data

US 2021/0079605 A1 Mar. 18, 2021

(51) Int. Cl.
*E01F 8/00* (2006.01)
*G10K 11/162* (2006.01)

(52) U.S. Cl.
CPC ..... *G10K 11/162* (2013.01); *E01F 8/0017* (2013.01); *E01F 8/0023* (2013.01)

(58) Field of Classification Search
CPC ..... E01F 15/088; E01F 15/02; E01F 15/08; E01F 15/083; E01F 15/086; E01F 8/0017; E01F 8/0023; E01F 8/0088; E01F 8/00; E01F 8/0005; G10K 11/16; G10K 11/162
See application file for complete search history.

(56) References Cited

U.S. PATENT DOCUMENTS 2,868,485 A 1/1959 Friel
3,885,362 A * 5/1975 Pollock ..... E04B 2/7409 52/270
4,111,401 A * 9/1978 Pickett ..... E01F 8/0017 52/223.7
4,214,411 A 7/1980 Pickett
4,274,506 A 6/1981 Blomgren
4,397,441 A 8/1983 Manderla
4,930,752 A 6/1990 Wolper
(Continued)

FOREIGN PATENT DOCUMENTS

CA 2661370 A1 * 9/2010 ..... E01F 8/0011
KR 20180109435 A * 10/2018 ..... E01F 8/0017
(Continued)

OTHER PUBLICATIONS

McAllister, Wade J., Temporary Exterior Noise Interruption Pollution Wall, Copending Canadian Patent Application, CA 3,055,844, Filing Date Sep. 18, 2019.

*Primary Examiner* — Edgardo San Martin
(74) *Attorney, Agent, or Firm* — David Guerra

(57) ABSTRACT

A noise barrier system and method for quickly and modularly installing or erecting a temporary sound interruption wall. The system can include one or more panels each, a leveling bracket adjustably mountable to a support member, a clamping bracket for mounting a panel to a support member, a double clamping bracket for clamping a pair of panels together and mounting them to a support member, and a panel clamp for clamping a pair of panels together. The leveling bracket can include a support wall to support portions of adjacent panels, and an arm for removably securing to a flange of the support member. The panel clamp, the clamping bracket and the double clamping bracket can each include open channel configuration configured to receive a single portion of a panel or portions of pair panels, and a slidably adjustable clip for securing the portion of the panels therein.

20 Claims, 6 Drawing Sheets

(56) References Cited

U.S. PATENT DOCUMENTS

| | | | | | |
|---|---|---|---|---|---|
| 5,265,396 | A * | 11/1993 | Amimoto | E04F 13/0855 | 52/235 |
| 5,845,450 | A | 12/1998 | Larsen | | |
| 6,098,364 | A * | 8/2000 | Liu | E04F 13/0855 | 52/235 |
| 6,128,883 | A * | 10/2000 | Hatzinikolas | E04B 1/4178 | 52/378 |
| 7,220,077 | B2 | 5/2007 | Humphries et al. | | |
| 8,028,494 | B2 | 10/2011 | Denn | | |
| 8,051,623 | B2 * | 11/2011 | Loyd | E04F 13/0803 | 52/489.1 |
| 8,567,140 | B2 * | 10/2013 | Wagner | E04F 13/142 | 52/475.1 |
| 8,616,331 | B2 | 12/2013 | Humphries et al. | | |
| 10,323,419 | B2 * | 6/2019 | Hatzinikolas | E04F 13/0857 | |
| 2003/0006090 | A1 | 1/2003 | Reed | | |
| 2005/0161564 | A1 * | 7/2005 | Ganske | E04F 21/185 | 248/220.21 |
| 2016/0160458 | A1 * | 6/2016 | Oeler | E04H 17/22 | 52/745.09 |
| 2019/0071859 | A1 * | 3/2019 | Gill | E04B 2/60 | |
| 2019/0211518 | A1 | 7/2019 | Humphries et al. | | |
| 2019/0234031 | A1 | 8/2019 | Emborg et al. | | |
| 2019/0309899 | A1 | 10/2019 | Duarte | | |

FOREIGN PATENT DOCUMENTS

| | | | | |
|---|---|---|---|---|
| KR | 102309937 B1 * | 10/2021 | | E01F 8/0023 |
| WO | WO-2014062128 A1 * | 4/2014 | | E01F 8/0011 |

* cited by examiner

TEMPORARY NOISE POLLUTION INTERRUPTION WALL SYSTEM AND METHOD

CROSS-REFERENCE TO RELATED APPLICATION

The present application claims priority under 35 U.S.C. 119(a) to Canada (CA) patent application number 3,055,844 filed on Sep. 18, 2019, which is incorporated herein by reference in its entirety.

BACKGROUND

Technical Field

The present technology relates to a temporary noise pollution interruption wall system and method for use in connection with quickly and modularly installing or erecting a temporary sound interruption wall.

Background Description

The creation of the automobile, the airplane, and mighty train have created the need to reduce such increases in noise pollution. As the earth's population grows the need for more development of cities, towns, communities, natural, and ecofriendly resources are growing. The ever-growing need for the industrial energy sector to develop these resources is the main cause of noise pollution that exceeds allowable levels in areas of human habitation. Examples of the machinery used to develop these resources are generators, pumps, hydraulic fracturing systems, heavy equipment, and continuous vehicular traffic. By default the machinery used produce continuous and higher than acceptable levels of noise pollution.

Increasing evidence that continuous noise pollution at elevated levels associated with vehicles, construction equipment, fracturing equipment, and most machinery that emits high levels of audible sound are detrimental to the mental and physical health of humans and wildlife. This can affect who reside, work, and roam in the vicinity of these industrial energy sector projects.

It is common to utilize reinforced concrete safety barriers positioned along boundaries of highways, roadways, sport and concert arenas or fields, and industrial complexes. These barriers are typically steel reinforced concrete barriers, which are joined one to the other in end-to-end relation so as to form a continuous barrier means with each safety barrier forming one section thereof. These known barriers are commonly referred to as "Jersey" barriers, and difficult to transport and install. In combination with reducing noise pollution to the surround neighborhoods, these known barriers also reduce or lessen the chances of an automobile from driving off the road or bridge, thereby reducing injury during an accident. However, to accomplish this, these barriers are made of thick reinforced concrete, which increases their cost of manufacture and installation.

It is known during installation of these beams to drive or bury a series of "I" or "H" channeled beams into the ground at spaced apart distances from each other. Panels are lifted by crane or hoist and positioned so ends of the panel are received in the channel between beams. A large crane is typically required to lift and position the panels because of their heavy weight. These panels are not able to be adjusted when slid into position, and if they become dislodged by an impacting vehicle, wind, earthquake or other forces, then they could fall over and potentially injury nearby people or damage nearby property.

A growing number of local, municipal, federal and/or governmental agencies are looking for sound barrier systems that can reduce the emitting of noise pollution surrounding human habitable areas throughout the country. Therefore, there is a need for a temporary exterior noise pollution interruption wall(s) or system that has a measurable noise pollution interruption co-efficient and that is easy to temporarily erect in areas deemed to require a reduction in noise pollution.

While the above-described devices fulfill their respective, particular objectives and requirements, the aforementioned devices or systems do not describe a temporary noise pollution interruption wall system and method that allows quickly and modularly installing or erecting a temporary sound interruption wall. The present technology overcomes one or more of the disadvantages associated with known noise barriers.

A need exists for a new and novel temporary noise pollution interruption wall system and method that can be used for quickly and modularly installing or erecting a temporary sound interruption wall. In this regard, the present technology substantially fulfills this need. In this respect, the temporary noise pollution interruption wall system and method according to the present technology substantially departs from the conventional concepts and designs of the prior art, and in doing so provides an apparatus primarily developed for the purpose of quickly and modularly installing or erecting a temporary sound interruption wall.

SUMMARY

In view of the foregoing disadvantages inherent in the known types of noise barrier systems, the present technology provides a novel temporary noise pollution interruption wall system and method, and overcomes one or more of the mentioned disadvantages and drawbacks of the prior art. As such, the general purpose of the present technology, which will be described subsequently in greater detail, is to provide a new and novel temporary noise pollution interruption wall system and method and method which has all the advantages of the prior art mentioned heretofore and many novel features that result in a temporary noise pollution interruption wall system and method which is not anticipated, rendered obvious, suggested, or even implied by the prior art, either alone or in any combination thereof.

According to one aspect, the present technology can include a noise barrier system including a panel and a leveling bracket mountable to a support member. The panel can include a panel frame. The leveling bracket can be adjustably mountable to the support member. The leveling bracket can include a support wall and an arm. The support wall can be configured to support a first portion of the panel. The arm can be configured to removably secure the leveling bracket to one or more flanges of the support member, and can be configured to adjust a levelness or angular orientation of the leveling bracket.

In some embodiments, the panel can include at least one pin extending from the panel frame, and a loop at a free end of the pin.

In some embodiments, the pin and loop can be configured to be received in a cavity defined in a panel frame of an adjacent panel when orientated in an abutting configuration.

In some embodiments, the panel can include a blanket attachable to the panel frame.

In some embodiments, the leveling bracket can include a front wall extending from a first edge of the support wall, a back wall extending from a second edge of the support wall opposite the first edge, and a pair of side walls each extending from the support wall to the back wall. The front wall and the back wall can be parallel and can extend from the support wall in opposite directions.

In some embodiments, the arm of the leveling bracket can be a pair of L-shaped arms each being attachable to one of the side walls so that an arm flange of each of the L-shaped arms face each other and define a space between the arm flange and the back wall.

In some embodiments, the spaced defined between the arm flange of the L-shaped arms and the back wall can be configured to receive at least one of the flanges of the support member.

In some embodiments, the arm flange of the L-shaped arms can be configured to adjust an angular orientation of the leveling bracket against the support member.

In some embodiments, the support wall can have a length configured to contact the first portion of the panel and a first portion of a second panel positioned adjacent to the panel.

Some embodiments of the present technology can include a clamping bracket adjustably mountable to the support member. The clamping bracket can have an open channel configuration configured to receive a second portion of the panel. The clamping bracket can include a lateral extension configured to be secured to at least one of the flanges of the support member.

In some embodiments, the clamping bracket can include a web wall, a first flange and a second flange all configured to provide the open channel configuration configured of the clamping bracket. A clamping bracket clip can be adjustably attachable to the first flange of the clamping bracket so that a stop wall extends over the open channel configuration of the clamping bracket. The clamping bracket clip can define a slot configured to slidably receive a first clamping bracket fastener for securing the clamping bracket clip to the first flange of the clamping bracket.

In some embodiments, the second flange of the panel clamp can have a length greater than a length of the first flange of the panel clamp.

In some embodiments, the second flange of the clamping bracket can define an aperture therethrough configured to threadably engage with a second clamping bracket fastener configured to push the second portion of the panel toward the first flange of the clamping bracket.

Some embodiments of the present technology can include a panel clamp including a web wall, a first flange and a second flange all configured to provide an open channel configuration configured to receive a second portion of the panel and a first portion of an adjacent panel abutting the second portion of the panel. A panel clamp clip can be adjustably attachable to the first flange so that a stop wall extends over the open channel configuration of the panel clamp. The panel clamp clip can define a slot configured to slidably receive a first panel clamp fastener for securing the panel clamp clip to the first flange of the panel clamp.

In some embodiments, the second flange of the panel clamp can have a length greater than a length of the first flange of the panel clamp.

In some embodiments, the second flange of the panel clip can define an aperture therethrough configured to threadably engage with a second panel clamp fastener configured to push the second portion of the panel and the first portion of the adjacent panel toward the first flange of the panel clamp.

Some embodiments of the present technology can include a double clamping bracket including a web wall, a first flange and a second flange all configured to provide an open channel configuration configured to receive a second portion of the panel and a first portion of an adjacent panel abutting the second portion of the panel. A double clamping bracket clip can be adjustably attachable to the first flange of the double clamping bracket so that a stop wall extends over the open channel configuration of the double clamping bracket. The double clamping bracket clip can define a slot configured to slidably receive a first double clamping bracket fastener for securing the double clamping bracket clip to the first flange of the double clamping bracket.

In some embodiments, the second flange of the double clamping bracket can have a length greater than a length of the first flange of the double clamping bracket.

In some embodiments, the second flange of the double clamping bracket can define an aperture therethrough configured to threadably engage with a second double clamping bracket fastener configured to push the second portion of the panel and the first portion of the adjacent panel toward the first flange of the double clamping bracket.

According to another aspect, the present technology can include a noise barrier system including one or more panels, a leveling bracket adjustably mountable to a support member, a panel clamp, a clamping bracket and a double clamping bracket. Each of the panels can include a panel frame. The leveling bracket can include a support wall and an arm. The support wall can be configured to support a first portion of the panel. The arm can be configured to removably secure the leveling bracket to one or more flanges of the support member. The panel clamp can define an open channel configuration configured to receive adjacent sections of a pair of the panels abutting each other. A panel clamp clip can be adjustably attachable to the panel clamp so that a stop wall of the panel clamp clip extends over the open channel configuration of the panel clamp. The clamping bracket can define an open channel configuration configured to receive a section of at least one of the panels. A clamping bracket clip can be adjustably attachable to the clamping bracket so that a stop wall of the clamping bracket clip extends over the open channel configuration of the clamping bracket. The double clamping bracket can define an open channel configuration configured to receive adjacent sections of a pair of the panels abutting each other. A double clamping bracket clip can be adjustably attachable to double clamping bracket so that a stop wall of the double clamping bracket clip extends over the open channel configuration of the double clamping bracket.

According to yet another aspect, the present technology can include a method of a installing or erecting a noise barrier system including the steps of attaching at least one leveling bracket to one or more supper members spaced apart from each other. Adjusting a height or angle of at least one of the leveling brackets. Placing panels on top of a support wall of the leveling brackets to form a horizontal row of panels. Stacking at least one vertical panel on top of at least one of the panels of the horizontal row of panels so that a pin of the at least one panel is received in a cavity of a panel frame of the vertical panel. Attaching a panel clamp around sections of the panel frame of the panels that are adjacent and abutting each other. Attaching a clamping bracket to at least one section of the panel frame of at least one of the panels, and attaching the clamping bracket to at least one of the support members. Attaching a double clamping bracket to sections of the panel frame of the panels that are adjacent and abutting each other, and attaching the double clamping bracket to at least one of the support members.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

It is therefore an object of the present technology to provide a new and novel temporary noise pollution interruption wall system and method that has all of the advantages of known noise barrier systems and none of the disadvantages.

It is another object of the present technology to provide a new and novel temporary noise pollution interruption wall system and method that may be easily and efficiently manufactured and marketed.

An even further object of the present technology is to provide a new and novel temporary noise pollution interruption wall system and method that has a low cost of manufacture with regard to both materials and labor, and which accordingly is then susceptible of low prices of sale to the consuming public, thereby making such temporary noise pollution interruption wall system and method economically available to the buying public.

Still another object of the present technology is to provide a new temporary noise pollution interruption wall system and method that provides in the apparatuses and methods of the prior art some of the advantages thereof, while simultaneously overcoming some of the disadvantages normally associated therewith.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology. Whilst multiple objects of the present technology have been identified herein, it will be understood that the claimed present technology is not limited to meeting most or all of the objects identified and that some embodiments of the present technology may meet only one such object or none at all.

BRIEF DESCRIPTION OF THE DRAWINGS

The present technology will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE EMBODIMENTS

Figure 1:
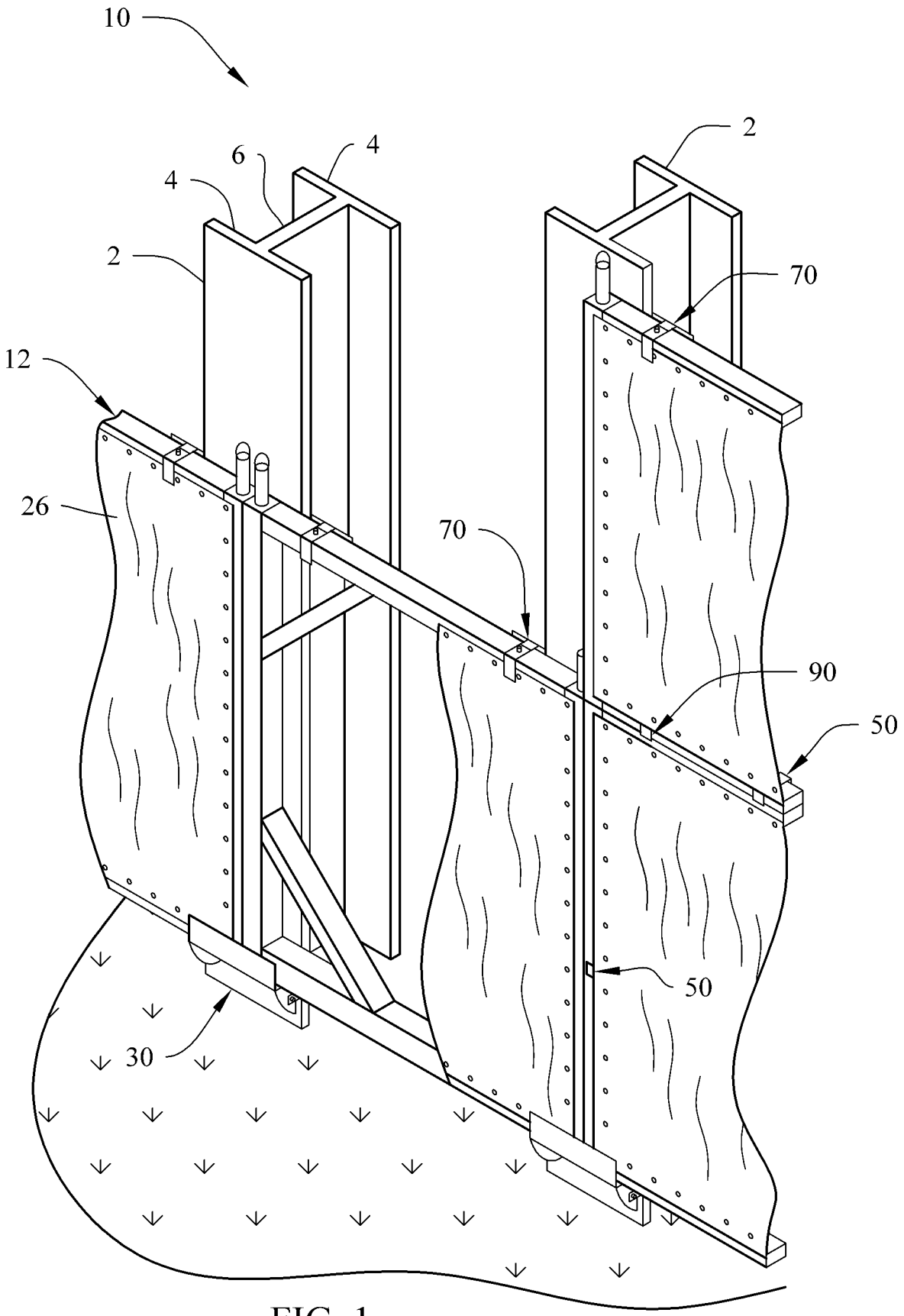
FIG. 1 is a perspective view of an embodiment of the temporary noise pollution interruption wall system and method constructed in accordance with the principles of the present technology, with a portion of the panel removed for viewing of elements therebehind.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

One objective of the present technology is to provide a temporary exterior noise pollution interruption wall system for, but not limited to, vehicle or aircraft traffic areas and/or industrial energy sector projects. Reducing the noise pollution is the objective set forth through public engagements and the introduction on noise regulations in certain industries. The present technology will decrease noise pollution impacts while temporarily installed, all the while increasing safety parameters, increasing efficiencies of installations and dismantling, and providing a superior product that maintains high standards of quality, sustainability, and effectiveness.

The present technology can relate in one aspect to a temporary noise pollution interruption pollution wall panel. This panel can feature an interlocking stackable design that increases the structural integrity of the system. Assembling individual panel(s) in any configuration pending application. The present technology components of the panel(s), which consists of at least two vertically supported channel defining members or beams. At least one wall panel with at least one clamp system attached for securement to the channel defining member. The individual panel(s) can be secured and erected to a height based on wind load calculations set forth by engineering standards and configured based on a stamped engineered erection plan for various applications and geographical locations.

An increase in the number of studies indicates that humans and wildlife are stressed by noise pollution causing a variety of impacts on the environment by disturbing mammal, bird, fish feeding and breeding patterns. This results in a need for a temporary noise pollution wall design and clamping securement system. More and more industrial, commercial and residential noise pollution is being created and the slowly ever-increasing need for a noise pollution barrier as per the present technology to help absorb and alleviate some of the noise pollution. The present technology allows for the development and interdiction of an interlocking panel design.

Referring now to the drawings, and particularly to FIGS. 1-14, an embodiment of the temporary noise pollution interruption wall system and method of the present technology is shown and generally designated by the reference numeral 10.

The system 10 can be utilized and/or configured to reduce noise pollution encounterable by surrounding people, homes, neighborhoods, etc., and capable of complying with noise regulations in certain industries. The present technology will decrease noise pollution impacts while temporarily installed, all the while increasing safety parameters, increasing efficiencies of installations and dismantling, and providing a superior product that maintains high standards of quality, sustainability, and effectiveness.

In FIG. 1, a new and novel temporary noise pollution interruption wall system and method 10 of the present technology for quickly and modularly installing or erecting a temporary sound interruption wall is illustrated and will be described. More particularly, the temporary noise pollution interruption wall system 10 includes one or more interlocking and stackable panels 12 that are attachable to a channel member 2 by way of a leveling bracket 30, a single clamping bracket 70 and/or a double clamping bracket 90. Adjacent panels 12 can be clamped together utilizing a double panel clamp 50. The channel member 2 can be a channeled beam, such as but not limited to "I", "C", "H", "S", "L", hollow steal section (HSS) or pipe beams, and can include a beam flange 4 and a web 6, where multiple channel members 2 can be driven or buried into the ground to create a perimeter or barrier along an area requiring noise pollution remediation. The interlocking and stackable nature of the panels 12 increases the structural integrity of the wall system 10.

It can be appreciated that any number of channel members 2 and/or panels 12 can be utilized as required, and in any configuration. Multiple panels 12 can be stacked on top of each other and erected to a height based on wind load calculations set forth by engineering standards, and configured based on a stamped engineered erection plan for various applications and geographical locations.

Figure 2:
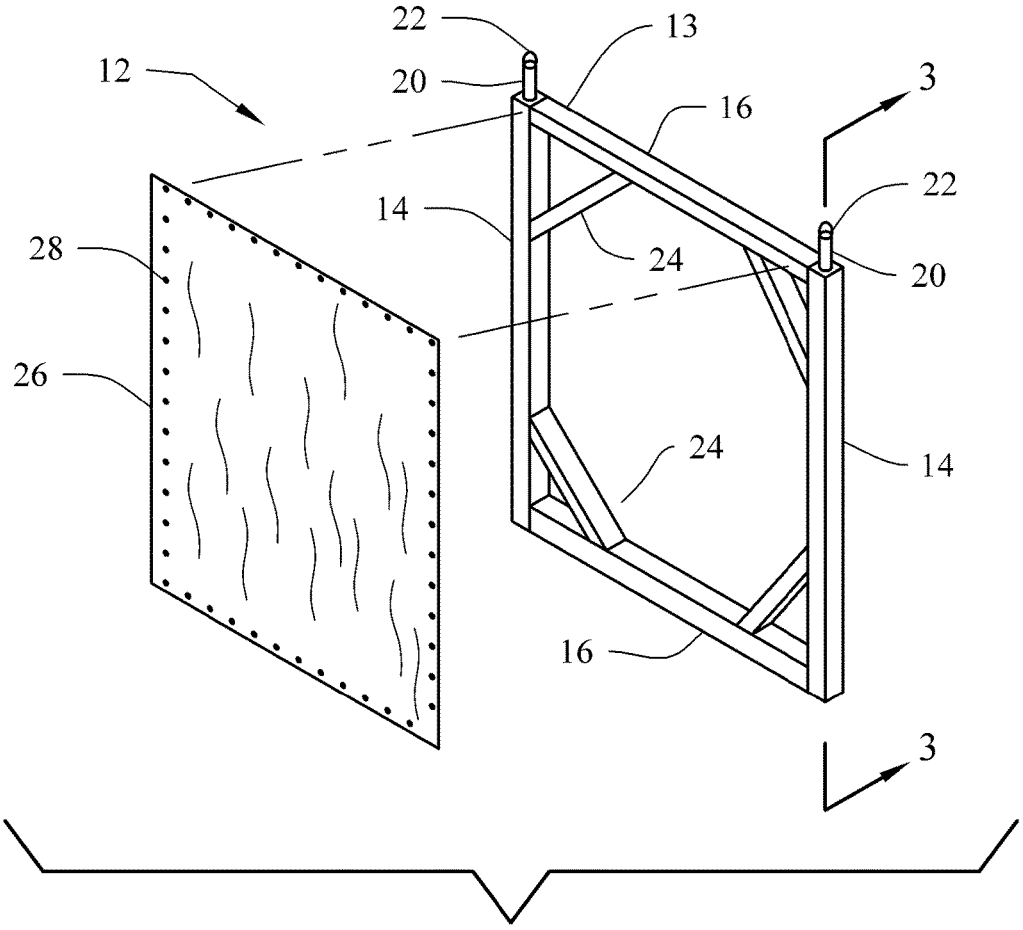
FIG. 2 is an exploded perspective view of the panel including the blanket and the panel frame of the present technology.
Figure 3:
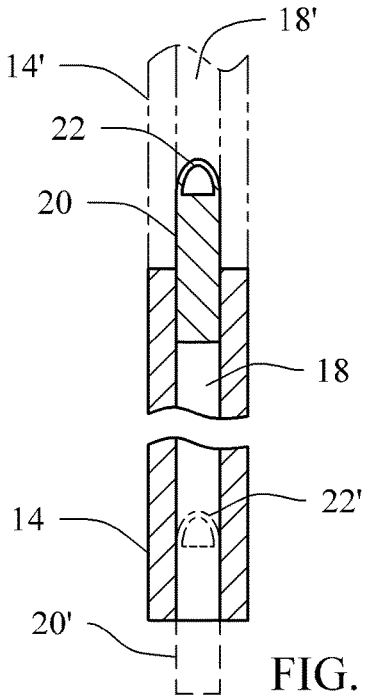
FIG. 3 is a cross-sectional view illustrating panel frames of the present technology assembled in a stacked relationship taken along line 3-3 in FIG. 2.
Figure 4:
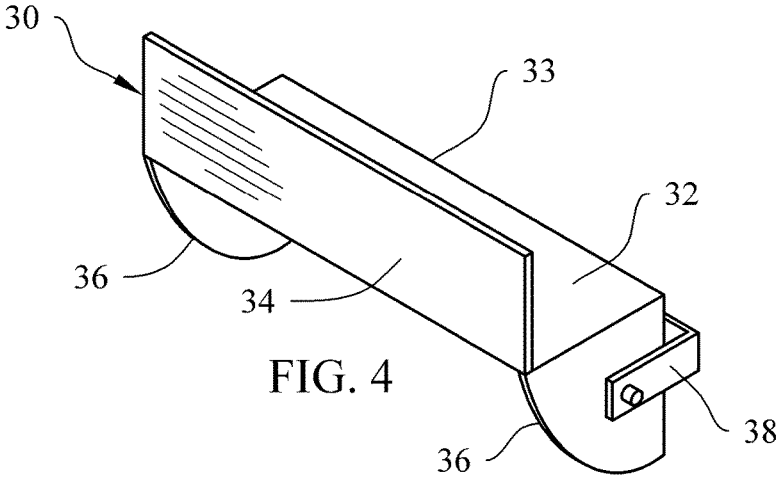
FIG. 4 is a perspective view of the leveling bracket of the present technology.

Referring to FIGS. 2 and 3, the panel 12 can include a panel frame 13 of any geometric configuration. In the exemplary, the panel frame 13 can include a pair of vertical members 14 and a pair of horizontal members 16, connected together to form a generally square or rectangular panel frame. The vertical members 14 and/or the horizontal members 16 can be constructed of extruded tubular material defining an internal cavity 18, as best illustrated in FIG. 3.

The two outer vertical member 14 make up the outer framework of the panel frame 13 along with two horizontal members 16. The horizontal members 16 can be placed vertically flush their corresponding vertical member 14. The ends of the horizontal members 16 can be fused, bolted, clamped or welded to an inside surface of the vertical members 14, respectively. This exemplary assembly constitutes the rectangular framework.

A gusset or cross-bracing member 24 can be utilized between vertical and horizontal members 14, 16 near their connections or formed corners, as best illustrated in FIGS. 1 and 2. The cross-bracing member 24 can span between the vertical members 14 and/or the horizontal members 16 near each corner of the panel frame 13, or can span between oppositely positioned vertical members 14 and/or horizontal members 16. The cross-bracing member 24 can be configured to increase the structural strength and/or rigidity of the panel 12. The cross-bracing members 24 can be made of extruded tubular sections.

A coupling or hoisting pin 20 can be associated with an end of each or any of the vertical members 14 and/or the horizontal members 16. In the exemplary, a first portion of the coupling pin 20 can be threadably engaged with internal threads defined in the cavity 18, while exposing a second portion. It can be appreciated that any part of the first portion of the pin 20 can be fused or welded to its corresponding vertical and/or horizontal member 14,16. The second portion of the pin 20 can have a tapering or conical configuration that convergingly tapers away from the first portion, thereby assisting in reception into the cavity 18' of the vertical member 14' of a stacked panel, as best illustrated in FIG. 3. The pin 20 can be secured in such a way that there is no interference with the other panels 12 when stacking vertically together.

An eyelet, hook or loop 22 can be associated with the second portion, and can be configured to be engaged with a hoisting element, such as but not limited to, a cable, rope, boom, etc. This allows for a cable or hook of a crane or lifting machine to attached to the panel 12 and hoist it into position.

In the alternative, the coupling pin 20 can include a flange that is fastenable to a surface of the vertical members 14 and/or the horizontal members 16, or the flange can be receivable and attachable to a surface in the cavity 18.

Further in the alternative, the first portion of the coupling pin 20 can include one or more biased tabs or fingers featuring a button or detent at or near its free end. The vertical members 14 and/or the horizontal members 16 can defined a bore therethrough configured to align with the detent when the first portion of coupling pin 20 is inserted into the cavity 18. Accordingly, the detent would be forced into the bore by way of the biasing nature of the finger or by a biasing member, thereby locking the coupling pin 20 in place. Removal would include pushing the detent from exterior the vertical members 14 and/or the horizontal members 16 and into the cavity 18, and pulling the coupling pin 20 out therefrom.

Even further in the alternative, a wall or ledge could extend into the cavity 18 that is configured to contact a free end of the first portion of the coupling pin 20 when inserted. The wall or ledge can be configured to prevent the coupling pin 20 from falling or being inserted completely into the cavity 18.

A noise absorbing or interruption blanket 26 can be fastened 28 to the panel frame 13, thereby created an assemble panel 12. The blanket 26 can be comprised of, but not limited to, a Dacron® polyester fabric and/or an ultra-violet (UV) all weather protective fabric that form the outer or exterior layers of the blanket 26. Between the Dacron polyester fabric UV all weather protective fabric out layers can encapsulate, but not limited chopped strand fiberglass, foams or any other sound absorbing material. With the chopped strand fiberglass layered between the two exterior layers, these combined materials can be, but not limited to, triple stitched or fused together to make up the blanket 26. The blanket 26 can cover one or both sides of the entire panel frame 13.

Referring to FIGS. 4-8, the leveling bracket 30 can be attached or clamped to one or more flanges 4 of the beam 2. The leveling bracket 30 can be installed towards a bottom of a pair of beams 2 near the ground, with one or both of the leveling brackets 30 vertically adjusted so that the pair of leveling brackets 30 are level with each other. By installing the leveling bracket 30 towards the bottom of the beam 2, this will allow starting the panel(s) 12 alignment level. The leveling bracket 30 can be aligned at a 90° angle with the panel 12.

Figure 7:
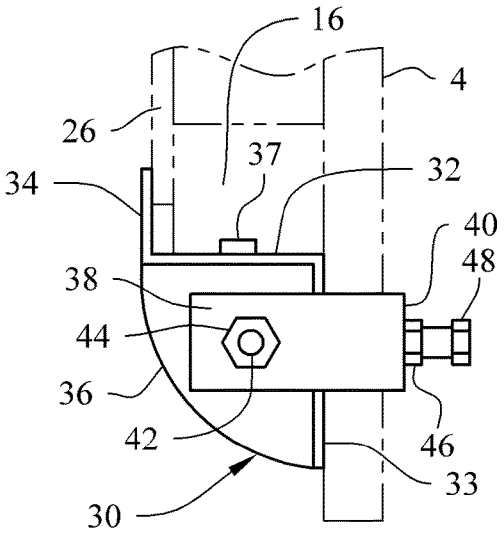
FIG. 7 is a right side plan view of the leveling bracket of the present technology attached to the flange of the beam and supporting the panel.
Figure 8:
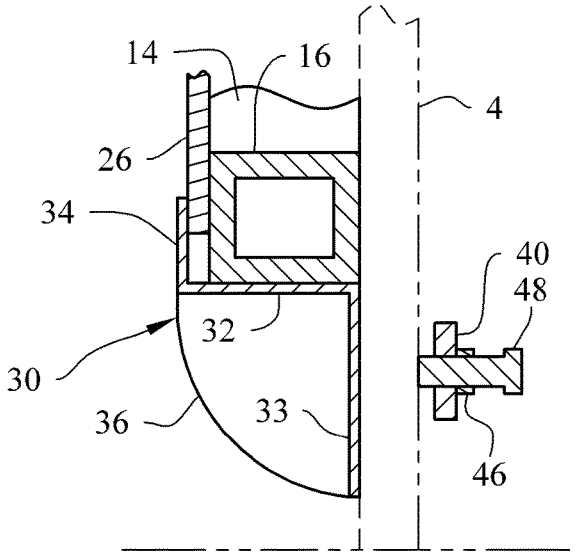
FIG. 8 is a cross-sectional view of the leveling bracket of the present technology taken along line 8-8 in FIG. 7.

The leveling bracket 30 can include a horizontal support wall 32, a vertical back wall 33 transitioning from an edge of the horizontal support wall 32, and a vertical front wall 34 transitioning from an opposite edge of the horizontal support wall 32, all of which can be constructed in the shape of a horizontal "Z" or "S", best illustrated in FIGS. 7 and 8.

A pair of gussets or side walls 36 can extend between outer most ends of the support wall 32 and an end of back wall 33, respectively. An exterior edge of the side walls 36 can be angled or curved. An open space is defined between the pair of side walls 36, an interior side of the support wall 32 and an interior side of the back wall 33.

An L-shaped arm 38 can be removably and adjustably secured to an exterior side of each of the side walls 36. The L-shaped arm 38 includes a 90° flange 40, thereby creating the general L-shape of the arm 38.

Each of the side walls 36 can include a threaded or non-threaded aperture that is configured to receive there-through a threaded fastener 42. Each of the arms 38 can include a threaded aperture or non-threaded aperture with a threaded receiver 44 aligned and fixed therewith.

The L-shaped arm 38 can be placed against an exterior side of each of the side walls 36 so that their apertures are aligned and the flanges 40 are facing each other. The fastener 42 can be received through the side wall aperture so that a head of the fastener is located inside the open space defined between the pair of side walls 36, and then threadably engaged with the threaded aperture of the threaded receiver 44 of the side wall 36, thereby assembling the L-shaped arm 38 to the side walls 36, respectively. In the alternative, the fastener 42 can be received through the L-shaped arm aperture so that its head is exterior thereof and then thread-ably engaged with the threaded aperture of the side walls 36, respectively.

It can be appreciated that either the side wall aperture and/or the L-shaped arm aperture can be a slot, configured to allow the L-shaped arm 38 to slidably adjust thereto and adjust a space between the flange 40 and the back wall 33.

The flange 40 can include a threaded aperture or a non-threaded aperture with a threaded receiver 46 aligned and fixed therewith. When the L-shaped arm 38 is assembled with the side walls 36, a threaded fastener 48 can be received through the threaded flange aperture or the threaded receiver 46 so that a shaft end of the fastener 48 comes in contact with an interior side of the beam flange 4, respectively, as best illustrated in FIG. 8, thereby clamping the leveling bracket 30 to the beam. It can be appreciated that continued tightening or turning of the fastener 48 would pull the leveling bracket 30 towards an exterior side of the beam flange 4 until an exterior side of the back wall 33 contacts the exterior side of the beam flange. Further continued tightening of the fastener 48 would increase the clamping force on the beam flange 4. In the alternative, the L-shaped arms 38 can be fused, welded, locked or clamped to their respective side walls 36.

When assemble to the beam 2, the leveling bracket 30 can be configured to support one or more panels 12, and in some cases a pair of adjacent panels 12, as best illustrated in FIG. 1. The supporting aspect of the level bracket 30 can be accomplished by placing a adjacent pair of panels 12 on the level bracket 30 so that adjacent ends of a bottom horizontal member 16 are equally supported by the support wall 32, with a portion of the blanket 26, the vertical member 14 and the horizontal member 16 positioned between the front wall 34 and beam flange 4, as best illustrated in FIGS. 7 and 8.

Figure 5:
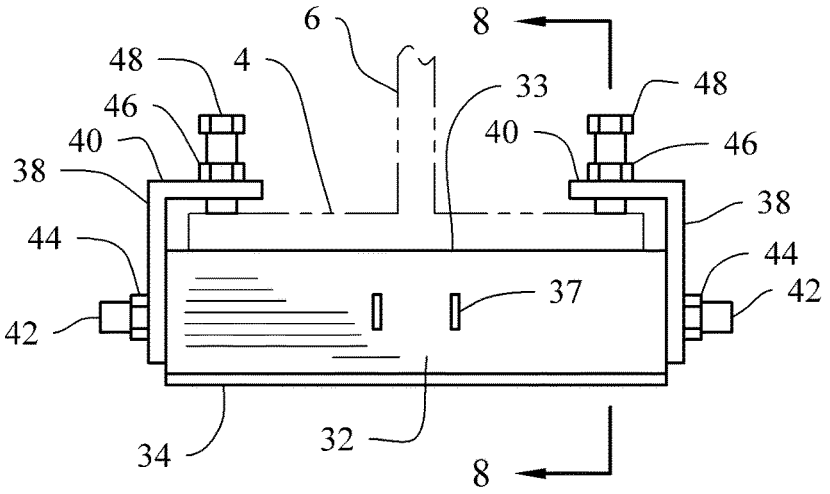
FIG. 5 is a top elevational view of the leveling bracket of the present technology attached to the flange of the beam.
Figure 6:
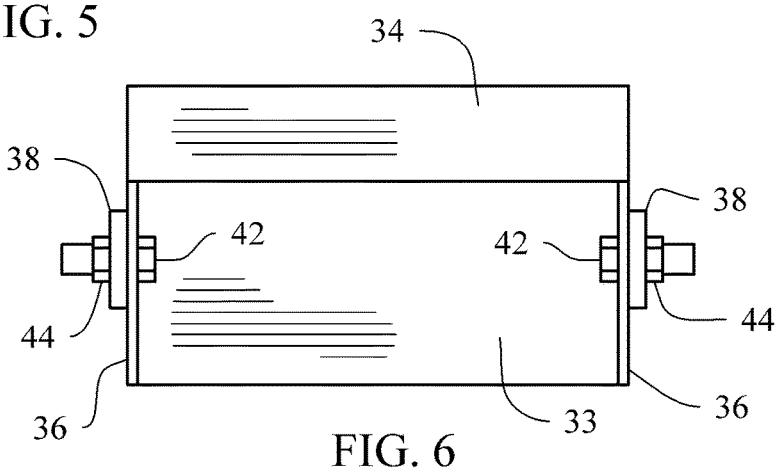
FIG. 6 is a front plan view of the leveling bracket of the present technology.

Alternatively, the support wall 32 can include one or more tabs 37 extended up therefrom, as best illustrated in FIG. 5. Each of the tabs 32 can be received in a slot defined in the vertical or horizontal member 14, 16 or in the cavity 18 of the vertical member 14 when placed on the support wall 32, thereby securing the panel 12 in position and preventing it from sliding off the support wall 32.

It can be appreciated that loosening the fasteners 48 allows a user to vertically adjust the leveling bracket 30 along the beam to vertically adjust the panel(s) 12 supported thereon. Further, loosening one of the fasteners 48 allows the user to vertically adjust one side of the leveling bracket 30, thereby adjusting a horizontal level of the leveling bracket.

Figure 9:
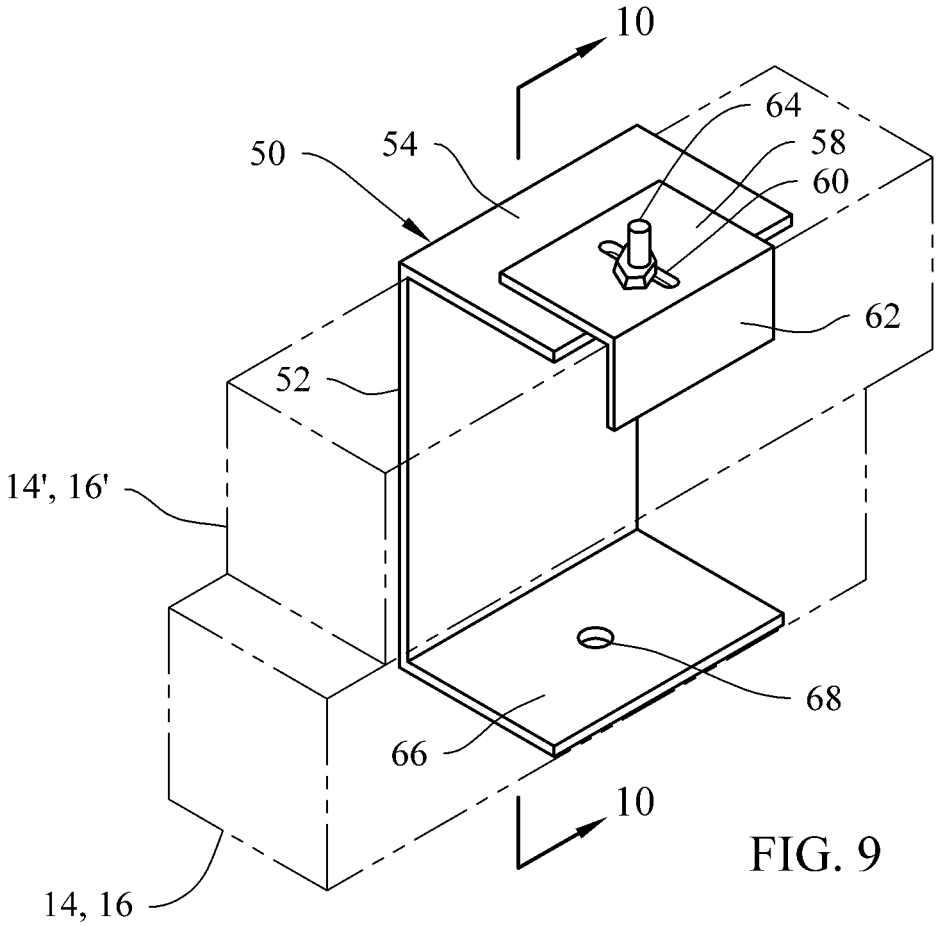
FIG. 9 is a perspective view of the double clamp of the present technology utilizable in the exemplary to clamp two or more adjacent panel frames.
Figure 10:
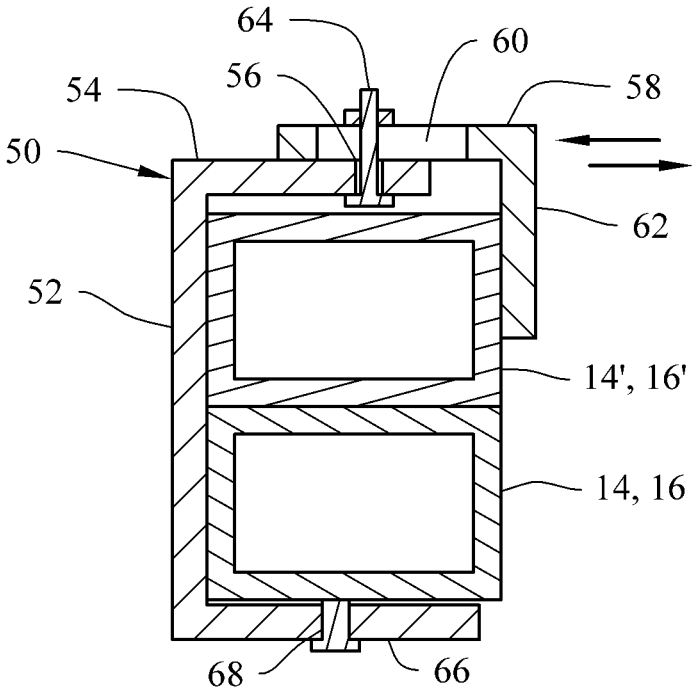
FIG. 10 is a cross-sectional view of the double clamp of the present technology taken along line 10-10 in FIG. 9.

Referring to FIGS. 9 and 10, the double panel clamp 50 can be utilized to clamp adjacent vertical and/or horizontal members 14, 16 of adjacent panel frames. The double panel clamp 50 can be configured as a C-shaped bracket can include a web wall 52, a first flange 54 and a second flange 66 opposite the first flange 54 to define an open spade therebetween. The first flange 54 can include an aperture 56, which can be threaded or non-threaded including a threaded receiver aligned and fixed therewith.

A clip 58 can be adjustably coupled to the first flange 54. The clip 58 can include a slot 60 defined therethrough and a 90° flange or stop wall 62. A fastener 64 can be received through the first flange aperture and the slot 60, and thread-ably engaged with a threaded receive exterior of the clip 58, thereby allowing the clip 58 to slidable adjust in relation to the first flange 54 and locking the clip 58 in place when tightened. Alternatively, the threaded fastener 64 can extend out from the first flange 54 to be received through the slot 60 and be engageable with a rotating threaded receive exterior the clip 58. Still in the alternative, the threaded fastener 64 can be received through the slot 60 and threadably engaged with a threaded receiver of the first flange 54.

The second flange 66 can have a length greater than a length of the first flange 54, and can include a threaded or non-threaded aperture 68 that can be configured to thread-ably receive another fastener to push the adjacent vertical or horizontal members 14, 16, 14', 16' toward the first flange 76, or a screw to secure the vertical or horizontal member to the second flange 66.

In operation, the double panel clamp 50, with the clip 58 removed, can be placed over the paired vertical and/or horizontal members of adjacent panel frames so that a first vertical or horizontal member 14, 16 and a second vertical or horizontal member 14', 16' are abutting each other between the first and second flanges 54, 66. After which, the clip 58 can be positioned on the first flange 54 so that the stop wall 62 contacts its respective vertical or horizontal member. After which, the fastener 64 can be tightened to lock the clip 58 in place, thereby clamping the adjacent panels together.

It can be appreciated that loosening the fastener 64 allows the clip 58 slide away from the first flange 54, thereby allowing for the double panel clamp 50 to slide along with adjacent panels and adjusting its position.

Figure 11:
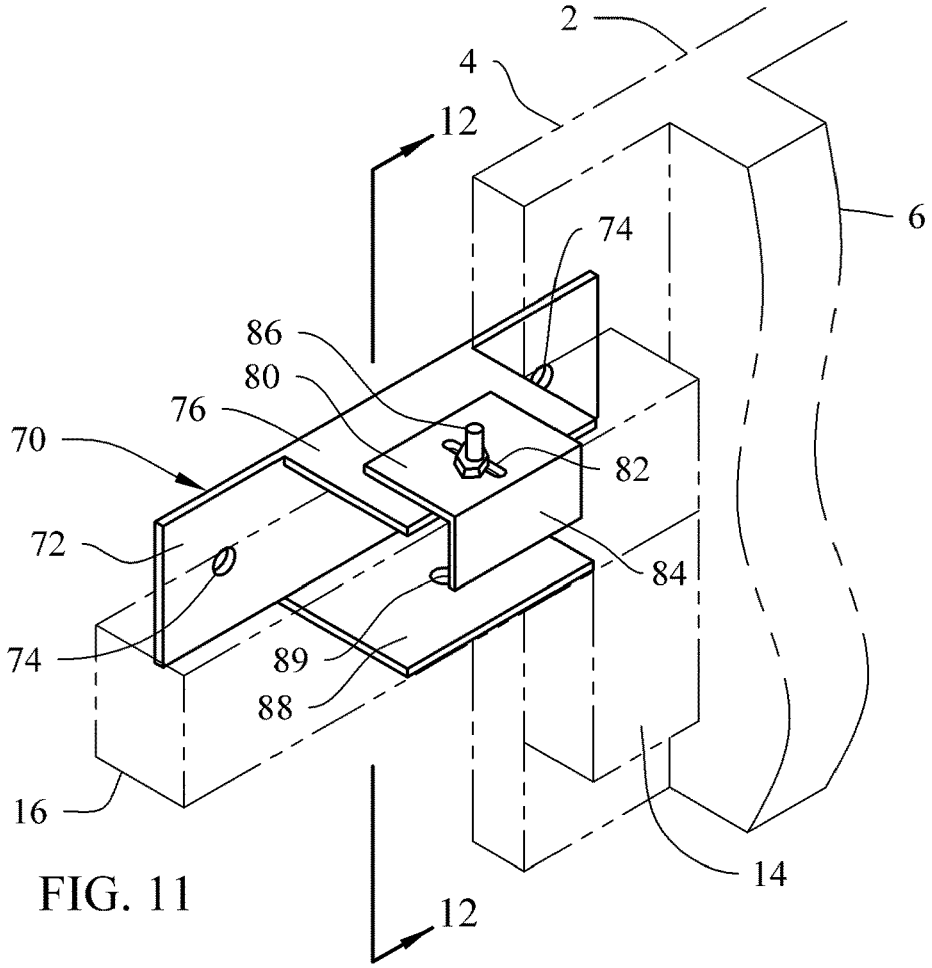
FIG. 11 is a perspective view of the single clamping bracket of the present technology utilizable in the exemplary to clamp a single panel frame to the beam.
Figure 12:
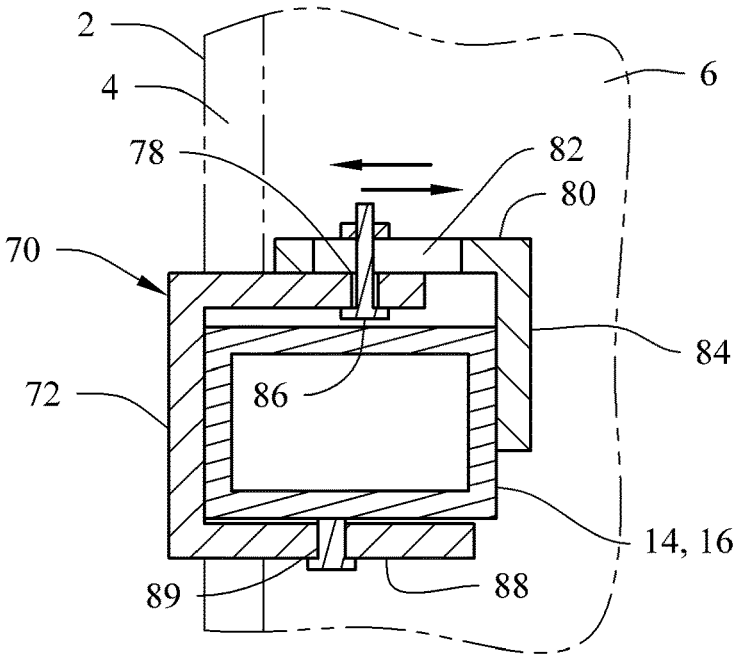
FIG. 12 is a cross-sectional view of the single clamping bracket of the present technology taken along line 12-12 in FIG. 11.

Referring to FIGS. 11 and 12, the single clamping bracket 70 can be utilized to clamp on to a vertical and/or horizontal member 14, 16 of a panel frame and attach the panel frame to one or more flanges 4 of the beam 2, to another adjacent panel frame or another object. The single clamping bracket 70 can be utilized to secure a single panel frame to the beam 2, and can be configured as a C-shaped bracket including a web wall 72, a first flange 76 and a second flange 88 opposite the first flange 76 to define an open spade therebetween.

The web wall 72 can have a pair of oppositely located lateral extensions that extend wider than a width of the first and second flanges 76, 88. The lateral extensions can each include a threaded aperture or non-threaded aperture 74 with a threaded receiver aligned and fixed therewith. A fastener or screw can be received through the aperture 74 to securing the single bracket 70 to the beam flange 4 of the beam or to a vertical or horizontal member of an adjacent panel or to any other surface.

The first flange 76 can include an aperture 78, which can be threaded or non-threaded including a threaded receiver aligned and fixed therewith.

A clip 80 can be adjustably coupled to the first flange 76. The clip 80 can include a slot 82 defined therethrough and a 90° flange or stop wall 84. A fastener 86 can be received through the first flange aperture 78 and the slot 82, and threadably engaged with a threaded receive exterior of the clip 80, thereby allowing the clip 80 to slidable adjust in relation to the first flange 76 and locking the clip 80 in place when tightened. Alternatively, the threaded fastener 86 can extend out from the first flange 76 to be received through the slot 82 and be engageable with a rotating threaded receive exterior the clip 80. Still in the alternative, the threaded fastener 86 can be received through the slot 82 and threadably engaged with a threaded receiver of the first flange 76.

The second flange 88 can have a length greater than a length of the first flange 76, and can include a threaded or non-threaded aperture 89 that can be configured to threadably receive another fastener to push the vertical or horizontal members 14, 16, toward the first flange 76, or a screw to secure the vertical or horizontal member to the second flange 88.

In operation, the single bracket 70, with the clip 80 removed, can be placed over the vertical and/or horizontal member 14, 16 of the panel frame so that the vertical or horizontal member is received in the space defined between the first and second flanges 76, 88. After which, the clip 80 can be positioned on the first flange 76 so that the stop wall 84 contacts its respective vertical or horizontal member. After which, the fastener 86 can be tightened to lock the clip 80 in place, thereby securing the vertical and/or horizontal member 14, 16 of the panel frame to the beam 2, another panel frame or another object.

It can be appreciated that loosening the fastener 86 allows the clip 58 slide away from the first flange 76, thereby allowing for the single bracket 70 to slide along the panel frame and adjusting its position. Furthermore, it can be appreciated that the loosening the fastener or screw associated with aperture 74 of the lateral web extension would allow the single bracket 70 so slide along the beam flange 4 of the beam 2 or an adjacent panel frame.

Figure 13:
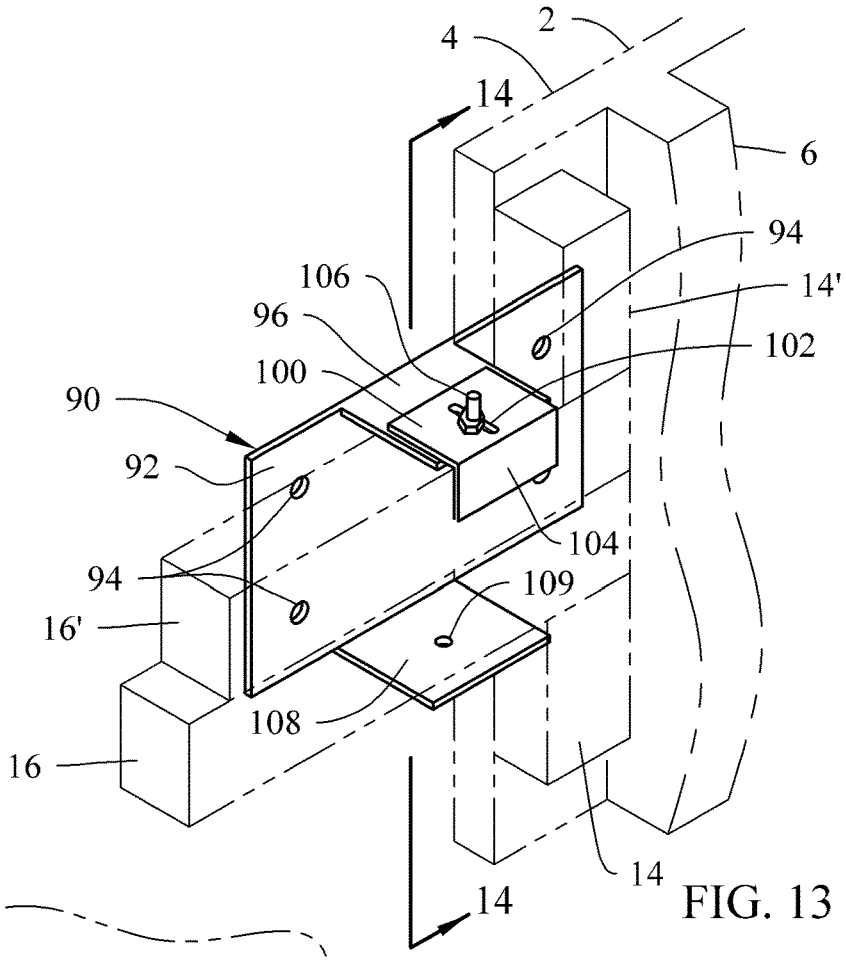
FIG. 13 is a perspective view of the double clamping bracket of the present technology utilizable in the exemplary to clamp two or more adjacent panel frames to the beam.
Figure 14:
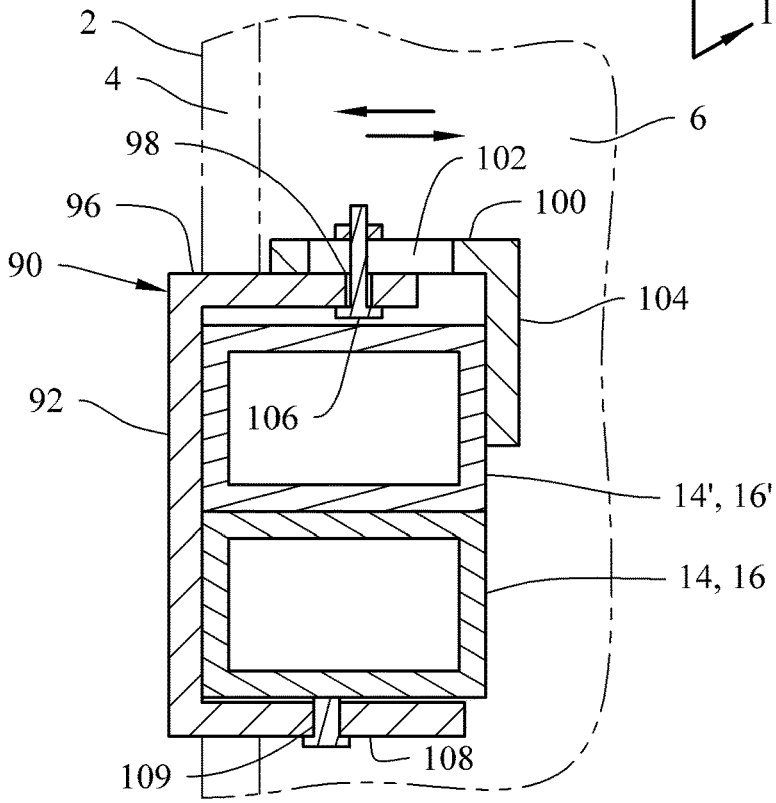
FIG. 14 is a cross-sectional view of the double clamping bracket of the present technology taken along line 14-14 in FIG. 13.

Referring to FIGS. 13 and 14, the double clamping bracket 90 can be utilized to clamp adjacent vertical and/or horizontal members 14, 16 of adjacent panel frames, and attach the paired panel frames to one or more flanges 4 of the beam 2, to another adjacent panel frame or another object. The double clamping bracket 90 can be utilized to clamp a pair of adjacent panel frame members to the beam 2, and can be configured as a C-shaped bracket including a web wall 92, a first flange 96 and a second flange 108 opposite the first flange 96 to define an open spade therebetween.

The web wall 92 can have a pair of oppositely located lateral extensions that extend wider than a width of the first and second flanges 96, 108. The lateral extensions can each include a threaded aperture or non-threaded aperture 94 with a threaded receiver aligned and fixed therewith. A fastener or screw can be received through the aperture 94 to securing the double bracket 90 to the beam flange 4 of the beam 2 or to a vertical or horizontal member of an adjacent panel or to any other surface.

The first flange 96 can include an aperture 98, which can be threaded or non-threaded including a threaded receiver aligned and fixed therewith.

A clip 100 can be adjustably coupled to the first flange 96. The clip 100 can include a slot 102 defined therethrough, and a 90° flange or stop wall 104. A fastener 106 can be received through the first flange aperture 98 and the slot 102, and threadably engaged with a threaded receive exterior of the clip 100, thereby allowing the clip 100 to slidable adjust in relation to the first flange 96 and locking the clip 100 in place when tightened. Alternatively, the threaded fastener 106 can extend out from the first flange 96 to be received through the slot 102 and be engageable with a rotating threaded receive exterior the clip 100. Still in the alternative, the threaded fastener 106 can be received through the slot 102 and threadably engaged with a threaded receiver of the first flange 96.

The second flange 108 can have a length greater than a length of the first flange 96, and can include a threaded or non-threaded aperture 109 that can be configured to threadably receive another fastener to push the paired vertical or horizontal members 14, 16, 14', 16' toward the first flange 96, or a screw to secure the vertical or horizontal member 14, 16, to the second flange 108.

In operation, the double bracket 90, with the clip 100 removed, can be placed over the paired vertical and/or horizontal members of adjacent panel frames so that a first vertical or horizontal member 14, 16 and a second vertical or horizontal member 14', 16' are abutting each other and are received in the space defined between the first and second flanges 96, 108. After which, the clip 100 can be positioned on the first flange 96 so that the stop wall 104 contacts its respective vertical or horizontal member. After which, the fastener 106 can be tightened to lock the clip 100 in place, thereby clamping the paired panel frames together, and further securing the paired panel frames to the beam 2, another panel frame or another object.

It can be appreciated that loosening the fastener 106 allows the clip 100 slide away from the first flange 96, thereby allowing for the double bracket 90 to slide along the panel frame and adjusting its position. Furthermore, it can be appreciated that the loosening the fastener or screw associated with aperture 94 of the lateral web extension would allow the double bracket 90 so slide along the beam flange 4 of the beam 2 or an adjacent panel frame.

With the above in mind and in the exemplary, the double clamping bracket 90 can be utilized as a universal clamp and mounting bracket for the left or the right sides of the channel member 2 when securing the panel(s). The ascribed lateral extensions are located on either side of the web wall 92 with each extension including a pair of apertures 94 capable of receiving a threaded fastener to push the received vertical or horizontal member toward the stop wall 104 of the clip 100 or a screw to secure its respective vertical or horizontal member to the web wall 92.

Alternatively, the web wall, the first flange, the second flange and/or the stop wall of any of the double panel clamp 50, the single clamping bracket 70 and/or the double clamping bracket 90 can include a tab extended in a direction toward their respective vertical or horizontal member received therein. The tab can be received in a slot defined in the vertical or horizontal member when placed assembly therewith, thereby securing the panel in position and preventing it from sliding off therefrom.

In use, it can now be understand in the exemplary that the present technology can include an assembly of components utilized to create a temporary noise pollution interruption wall system and method 10. Starting with a minimum of having at least two channel members 2 that are oriented vertically or horizontally, or one channel member 2 and a wall of a building. Once the two channel members 2 are secured, the installation of the leveling bracket(s) 30 can be installed at or near ground level plain on the channel defining member(s) 2. The leveling bracket(s) 30 can be installed to the outer face of the channel-defining member(s) 2 by placing the back wall 33 to butt up parallel against the outer face of the beam flange 4 of the channel member 2. Two outer L-shaped arms 38 support's and secures the leveling bracket 30 to the channel member 2. The L-shaped arms 38 are located on both outer side walls 36 that make up the leveling bracket 30. The L-shaped arms(s) 38 hardware can be installed by maneuvering the inner face to the outer portion of the L-shaped arms 38 into the inner portion of the beam flange 4 opposite its outer face of the channel member 2. As well, simultaneously aligning the through aperture 44 of the L-shaped arms 38 over the threaded fastener 42 affixed to the side walls 36. One or more of the installed leveling brackets 30 can be adjusted so that they are aligned and/or level with other leveling brackets 30, or are at a predetermined angle in relation to the ground.

Next as mentioned above in repeating the process of installing and secure all required leveling bracket 30. A first panel 12 can be hoisted into place utilizing the loop 22 of the hoisting pin 20. The extruded tubular outer panel frame 13, which makes up the panel 12, can be lowered onto the support wall 32 of the installed leveling bracket 30. With the panel 12 resting inside the leveling bracket 30, this is the first point of contact to securing the panel 12 to the vertically secured channel defining member(s) 2. The panel 12 can be placed on its respective leveling brackets 30 so that the panel's hoisting pins 20 are vertically oriented to receive another panel stacked thereupon, or horizontally oriented to slidably receive another panel placed adjacent thereto.

In the exemplary, the pin 20 can be secured in the top of each panel 12 via the outer tubular vertical members 14 as well as a centralized vertical extruded tubing upright(s). This allows for the next panel to be lowered into place a top the existing secured panel. This allows the panel(s) 12 to be installed together via the pin 20, which interlocks the panel(s) 12 allowing encompassing and securing the bottom panel housing the pin 20. Interlocking the panel(s) 12 can be a second point of securement. In this orientation, the second panel 12 could be hoisted by its hoisting pin 20 and placed sot that the cavity 18 associated with its vertical members 14 receives corresponding pins 20 of an already installed panel.

After the first panel 12 being hoisted and positioned into place the leveling brackets 30, a possible second point of contact or secure of the panel 12 can be installing the single clamping bracket 70 to the channel member 2.

The single clamping bracket 70 can be used to secure a single extruded tubular vertical or horizontal member 14, 16 of the panel 12. This can take place during assembly when the individual panel(s) 12 are being erected vertically and/or placed horizontally. The single clamping bracket 70 can be utilized as a securement clamping mechanism were a single vertical and/or horizontal member 14, 16 of the panel 12 requires to be secured to the channel member 2. With the clip 80 removed, the single clamping bracket 70 can be positioned to receive the vertical or horizontal member 14, 16 of the panel 12.

The clip 80 can then be attached to the first flange 76 and the single clamping bracket 70 can be positioned so that the aperture 74 of at least one of the lateral extensions of the web wall 72 is operably positioned with the beam flange 4 of the channel member 2 or to an adjacent vertical or horizontal member of an adjacent panel. The single clamping bracket 70 can then be secured to the channel member 2, and the clip 80 can be secured in place to clamp the panel 12 to the single clamping bracket 70, thereby securing the single panel 12 to the channel member 2 or the adjacent panel. Another fastener can be engagably utilized with the aperture 89 of the second flange 88 to push the vertical or horizontal member 14, 16 to the first flange 76, thereby further clamping the panel to the single clamping bracket 70.

It can be appreciated that using the ascribed bi-lateral extensions of the web wall 72 the threaded stub can be installed in both ascribed bi-lateral extensions and tightened to the inner flange of the channel member 2 with the opposite side being tightened and secured to the horizontal members 16, 16' and/or the cross-bracing member 24 of the paired panels 12, 12'.

With the first panel 12 in place and secured in the leveling bracket 30, and the single clamping bracket 70 now installed and secured, a next or subsequent panel can be positioned into place to start constructing the wall. Setting the next panel in place horizontally adjacent to existing secured panel, the same process will apply as followed and described in the above details when installing the first or bottom panel of the wall. The next panel can be placed onto the support wall 32 of the installed leveling bracket 30 and on a next or subsequent leveling bracket, so that one vertical member 14 of the first panel 12 is adjacent a vertical member of the next panel. This process can be repeated along the entire length of the wall.

The double panel clamp 50 can be utilized to clamp the adjacent vertical panels together, thereby securing the panels in succession. This can be accomplished by placing the double panel clamp 50, with its clip 58 removed over the paired vertical members 14, 14'. Then installing the clip 58 and tightening its fastener 64, thereby locking the clip 58 in place and clamping the paired vertical members 14, 14' together. Another fastener can be engagably utilized with the aperture 68 of the second flange 66 to push the paired vertical members 14, 14' to the first flange 54, thereby further clamping them together and to the double panel clamp 50.

To start the wall in a vertical direction a subsequent panel 12' must be positioned atop an existing secured panel 12. This subsequent panel can be hoisted into position then lowered onto the top of the already existing secured panel. The pin 20 a top of the existing panel 12 can be received into the cavity 18' of the vertical member 14' of the incoming panel 12'. This allows the panels to be the first point of contact securement together via the pin. With the next panel 12' in place resting on the pin 20 of the existing secured panel 12, the double clamping bracket 90 can be utilized for securement of the panels to the channel member 2.

The double clamping bracket 90 can be used to secure two adjacent panels when erected atop one another. This can take place during assembly when the individual panel(s) 12 are being erected vertically and/or placed horizontally. With its clip 100 removed, the double clamping bracket 90 can be positioned to receive the vertical or horizontal member 14, 16, 14', 16' of the paired panels 12, 12'.

The clip 100 can then be attached to the first flange 96 and the double clamping bracket 90 can be positioned so that the apertures 94 of at least one of the lateral extensions of the web wall 92 are operably positioned with the beam flange 4 of the channel member 2 or to an adjacent vertical or horizontal member of an adjacent panel. The double clamping bracket 90 can then be secured to the channel member 2, and the clip 100 can be secured in place to clamp the paired panels 12, 12' to the double clamping bracket 90, thereby securing the paired panels 12, 12' to the channel member 2 or the adjacent panel. Another fastener can be engagably utilized with the aperture 109 of the second flange 108 to push the paired vertical or horizontal members 14, 14', 16, 16' to the first flange 96, thereby further clamping them together and to the double clamping bracket 90.

It can be appreciated that using the ascribed bi-lateral extensions of the web wall 92 the threaded stub can be installed in both ascribed bi-lateral extensions and tightened to the inner flange of the channel member 2 with the opposite side being tightened and secured to the horizontal members 16, 16' and/or the cross-bracing member 24 of the paired panels 12, 12'.

With multiple vertical panels installed on top of each other, the double panel clamp 50 can be utilized to clamp adjacent vertical panels 12, 12' together, thereby securing the panels in vertical succession. This can be accomplished by placing the double panel clamp 50, with its clip 58 removed over the paired horizontal members 16, 16'. Then installing the clip 58 and tightening its fastener 64, thereby locking the clip 58 in place and clamping the paired horizontal members 16, 16' together. Another fastener can be engagably utilized with the aperture 68 of the second flange 66 to push the paired horizontal members 16, 16' to the first flange 54, thereby further clamping them together and to the double panel clamp 50.

Now with the wall constructed to its required vertical height the final securement can take place by installing the single clamping bracket 70 to a final top row of panels and/or a final column of panels to secure them to the channel member 2 or another object such but not limited to a wall of a building.

While embodiments of the temporary noise pollution interruption wall system and method have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although quickly and modularly installing or erecting a temporary sound interruption wall have been described, it should be appreciated that the temporary noise pollution interruption wall system and method herein described is also suitable for support and/or securing any paneled barrier or wall system either indoor or outdoor.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A noise barrier system comprising:

one or more panels each including a panel frame;

a leveling bracket adjustably mountable to a support member, the leveling bracket including a support wall and an arm, the support wall being configured to support a first portion of one or more of the panels, and the arm being configured to removably secure the leveling bracket to one or more flanges of the support member;

a panel clamp including an open channel configuration configured to receive adjacent sections of a pair of the panels abutting each other, and a panel clamp clip being adjustably attachable to the panel clamp so that a stop wall of the panel clamp clip extends over the open channel configuration of the panel clamp;

a clamping bracket including an open channel configuration configured to receive a section of at least one of the panels, and a clamping bracket clip being adjustably attachable to the clamping bracket so that a stop wall of the clamping bracket clip extends over the open channel configuration of the clamping bracket; and a double clamping bracket including an open channel configuration configured to receive adjacent sections of a pair of the panels abutting each other, and a double clamping bracket clip being adjustably attachable to double clamping bracket so that a stop wall of the double clamping bracket clip extends over the open channel configuration of the double clamping bracket.

2. A noise barrier system comprising:

a panel including a panel frame; and a leveling bracket adjustably mountable to a support member, the leveling bracket including a support wall and an arm, the support wall being configured to support a first portion of the panel, and the arm being configured to removably secure the leveling bracket to one or more flanges of the support member.

3. The noise barrier system according to claim 2, wherein the panel includes at least one pin extending from the panel frame, and a loop at a free end of the pin.

4. The noise barrier system according to claim 3, wherein the pin and loop are configured to be received in a cavity defined in a panel frame of an adjacent panel when oriented in an abutting configuration.

5. The noise barrier system according to claim 3, wherein the panel includes a blanket attachable to the panel frame.

6. The noise barrier system according to claim 2, wherein the leveling bracket includes a front wall extending from a first edge of the support wall, a back wall extending from a second edge of the support wall opposite the first edge, and a pair of side walls each extending from the support wall to the back wall, and wherein the front wall and the back wall are parallel and extending from the support wall in opposite directions.

7. The noise barrier system according to claim 6, wherein the arm of the leveling bracket is a pair of L-shaped arms each being attachable to one of the side walls so that an arm flange of each of the L-shaped arms face each other and define a space between the arm flange and the back wall.

8. The noise barrier system according to claim 7, wherein the spaced defined between the arm flange of the L-shaped arms and the back wall is configured to receive at least one of the flanges of the support member.

9. The noise barrier system according to claim 8, wherein the arm flange of the L-shaped arms are configured to adjust an angular orientation of the leveling bracket against the support member.

10. The noise barrier system according to claim 6, wherein the support wall has a length configured to contact the first portion of the panel and a first portion of a second panel positioned adjacent to the panel.

11. The noise barrier system according to claim 2 further comprising a clamping bracket adjustably mountable to the support member, the clamping bracket having an open channel configuration configured to receive a second portion of the panel, the clamping bracket including a lateral extension configured to be secured to at least one of the flanges of the support member.

12. The noise barrier system according to claim 11, wherein the clamping bracket includes a web wall, a first flange and a second flange all configured to provide the open channel configuration configured of the clamping bracket, and a clamping bracket clip is adjustably attachable to the first flange of the clamping bracket so that a stop wall extends over the open channel configuration of the clamping bracket, the clamping bracket clip defining a slot configured to slidably receive a first clamping bracket fastener for securing the clamping bracket clip to the first flange of the clamping bracket.

13. The noise barrier system according to claim 12, wherein the second flange of the panel clamp has a length greater than a length of the first flange of the panel clamp.

14. The noise barrier system according to claim 12, wherein the second flange of the clamping bracket defines an aperture therethrough configured to threadably engage with a second clamping bracket fastener configured to push the second portion of the panel toward the first flange of the clamping bracket.

15. The noise barrier system according to claim 2 further comprising a panel clamp including a web wall, a first flange and a second flange all configured to provide an open channel configuration configured to receive a second portion of the panel and a first portion of an adjacent panel abutting the second portion of the panel, and a panel clamp clip is adjustably attachable to the first flange so that a stop wall extends over the open channel configuration of the panel clamp, the panel clamp clip defining a slot configured to slidably receive a first panel clamp fastener for securing the panel clamp clip to the first flange of the panel clamp.

16. The noise barrier system according to claim 15, wherein the second flange of the panel clamp has a length greater than a length of the first flange of the panel clamp.

17. The noise barrier system according to claim 15, wherein the second flange of the panel clip defines an aperture therethrough configured to threadably engage with a second panel clamp fastener configured to push the second portion of the panel and the first portion of the adjacent panel toward the first flange of the panel clamp.

18. The noise barrier system according to claim 2 further comprising a double clamping bracket including a web wall, a first flange and a second flange all configured to provide an open channel configuration configured to receive a second portion of the panel and a first portion of an adjacent panel abutting the second portion of the panel, and a double clamping bracket clip is adjustably attachable to the first flange of the double clamping bracket so that a stop wall extends over the open channel configuration of the double clamping bracket, the double clamping bracket clip defining a slot configured to slidably receive a first double clamping bracket fastener for securing the double clamping bracket clip to the first flange of the double clamping bracket.

19. The noise barrier system according to claim 18, wherein the second flange of the double clamping bracket has a length greater than a length of the first flange of the double clamping bracket.

20. The noise barrier system according to claim 18, wherein the second flange of the double clamping bracket defines an aperture therethrough configured to threadably engage with a second double clamping bracket fastener configured to push the second portion of the panel and the first portion of the adjacent panel toward the first flange of the double clamping bracket.

* * * * *